US010709219B2

(12) United States Patent
Angelone

(10) Patent No.: US 10,709,219 B2
(45) Date of Patent: Jul. 14, 2020

(54) TRAVEL CHANGING APPARATUS AND METHOD

(71) Applicant: Jessica Angelone, Jackson, NJ (US)

(72) Inventor: Jessica Angelone, Jackson, NJ (US)

( * ) Notice: Subject to any disclaimer, the term of this patent is extended or adjusted under 35 U.S.C. 154(b) by 197 days.

(21) Appl. No.: 15/969,153

(22) Filed: May 2, 2018

(65) Prior Publication Data

US 2019/0159560 A1 May 30, 2019

Related U.S. Application Data

(60) Provisional application No. 62/590,923, filed on Nov. 27, 2017.

(51) Int. Cl.

| | |
|---|---|
| ***A45C 7/00*** | (2006.01) |
| ***A47D 5/00*** | (2006.01) |
| ***A45C 13/30*** | (2006.01) |
| ***A45C 9/00*** | (2006.01) |
| ***A45C 3/00*** | (2006.01) |

(52) U.S. Cl.

CPC ..... *A45C 7/0095* (2013.01); *A45C 3/00* (2013.01); *A45C 9/00* (2013.01); *A45C 13/30* (2013.01); *A47D 5/006* (2013.01); *A45C 2007/0004* (2013.01)

(58) Field of Classification Search

CPC ..... A45C 7/0095; A45C 3/00; A45C 9/00; A45C 13/30; A45C 5/006; A45C 2007/0004

See application file for complete search history.

(56) References Cited

U.S. PATENT DOCUMENTS

| | | | | | |
|---|---|---|---|---|---|
| 621,824 | A * | 3/1899 | Kleeman | A45C 7/0036 | 190/107 |
| 766,242 | A * | 8/1904 | Gordon | A45C 13/02 | |
| 1,972,027 | A * | 8/1934 | Mote | A47D 9/005 | 5/99.1 |
| 2,717,015 | A * | 9/1955 | Berry | A45C 11/20 | 150/117 |
| 3,173,465 | A * | 3/1965 | Electra | A45C 7/0063 | 150/108 |
| 3,262,283 | A * | 7/1966 | Taylor | F25D 3/08 | 62/372 |
| 3,336,608 | A * | 8/1967 | Lerner | A47D 15/003 | 5/99.1 |
| 4,180,114 | A * | 12/1979 | Katz | A45C 3/00 | 224/153 |

(Continued)

*Primary Examiner* — Tri M Mai
(74) *Attorney, Agent, or Firm* — Walter J. Tencza, Jr.

(57) ABSTRACT

An apparatus for changing a baby including a plurality of sections, connected together and configured to be placed in an open state, an assembled state, and a closed state; wherein in the open state, each of the plurality of sections lies in substantially the same plane, and none of the plurality of sections overlaps any of the other of the plurality of sections; wherein in the assembled state, a first section of the plurality of sections is temporarily fixed at substantially a right angle with respect to a second section of the plurality of sections; wherein in the closed state, the first section overlaps the second section; and wherein at least one of the first and second sections is padded. The apparatus may include a U-shaped strap connected to and used to pick up the plurality of sections, and a means for holding plurality of sections in the closed state.

17 Claims, 7 Drawing Sheets

(56) References Cited

U.S. PATENT DOCUMENTS 4,260,060 A * 4/1981 Faller ..... B65D 81/3453 219/732
4,538,732 A * 9/1985 Kuchenbecker ..... B65D 5/4295 229/104
4,791,883 A * 12/1988 Lehman ..... A01K 1/0125 119/168
4,901,897 A * 2/1990 Briggs ..... A45C 3/004 206/287.1
5,332,093 A * 7/1994 Littlepage ..... A45C 7/0095 190/102
5,802,647 A * 9/1998 Helmsderfer ..... A47D 5/003 108/38
5,904,230 A * 5/1999 Peterson ..... A45C 11/20 190/107
5,941,437 A * 8/1999 Okumura ..... A45C 3/00 224/585
6,076,485 A * 6/2000 Peeples ..... A01K 1/0254 119/496
6,193,034 B1 * 2/2001 Fournier ..... A45C 7/0095 190/107
6,595,358 B1 * 7/2003 Speck ..... A63B 55/00 206/315.9
6,918,147 B2 * 7/2005 Stackman ..... A47D 5/006 4/551
7,160,028 B1 * 1/2007 Linday ..... A45C 9/00 150/108
7,500,278 B2 * 3/2009 Leach ..... A47D 5/006 5/424
7,604,102 B2 * 10/2009 Albritton ..... A45C 3/00 190/107
D632,242 S * 2/2011 Currie ..... D12/416
9,199,580 B2 * 12/2015 Lehtonen ..... B60R 7/043
10,092,074 B2 * 10/2018 Rothschild ..... A45C 7/0036
2005/0230462 A1 * 10/2005 George ..... B65D 5/54 229/117.01
2007/0012695 A1 * 1/2007 Yang ..... A45C 5/02 220/8
2011/0119832 A1 * 5/2011 Hung ..... A47D 9/005 5/655

* cited by examiner

TRAVEL CHANGING APPARATUS AND METHOD

CROSS REFERENCE TO RELATED APPLICATION(S)

The present application claims the priority of U.S. Provisional Patent application Ser. No. 62/590,923, titled "Keep It Clean Travel Changing Station", filed on Nov. 27, 2017, inventor and application Jessica Angelone.

FIELD OF THE INVENTION

This invention relates to methods and apparatus which allow a baby's diaper to be changed.

BACKGROUND OF THE INVENTION

Changing a baby while traveling, running errands, going to a park, or even going to a restaurant is uncomfortable, inconvenient, unsanitary, and can become very stressful. Changing a baby in a vehicle or in any other location other than your home is not an easy task. Let's assume that you only have one car seat and have room in the back seat to change the baby. Since most back seats are concave, the baby's body shifts against the back seat where the hard seat belt connector is most likely against the baby's head/body. Once you dig through the diaper bag and retrieve a diaper and wipes, you undress the baby. Most likely, you are putting the baby's clothes on the floor of the vehicle along with the dirty diaper. Even if you change the baby without getting your clothes, the baby's clothes or worse, your vehicle, covered in urine or feces, a dirty diaper will remain in your vehicle until you can reach a trash can. Keep in mind, this is only possible if you only have one car seat in your vehicle. What do you do if you have more than one car seat in your vehicle? Hopefully not change the baby in the trunk, which some people may try.

If you are running errands or in the park you would most likely change the baby in the stroller. This can also be a difficult task as there is not much room in a stroller, most strollers do not lay completely flat, and the baby's legs are hanging down. If you dirty the stroller while changing the baby the baby will now be sitting in the feces or urine. You could also have a situation of the smelly diaper. This could be an unpleasant smell especially in the summer heat in a public garbage pail.

If you are at a restaurant or a public place that does not have changing tables, changing a baby can become creative and difficult. Even if a public restroom does have a changing table, how sanitary are they?

SUMMARY OF THE INVENTION

One or more embodiments of the present invention provide a travel changing station apparatus and method which can be the answer to all travel baby changing needs. In one or more embodiments, an apparatus is provided which is comfortable, convenient, clean, lightweight and easy to use. An apparatus and method is provided which makes changing a baby less stressful while traveling.

An apparatus of one or more embodiments, can be used anywhere inside of a vehicle; the back seat, the front passenger seat, and even on the driver's seat. It also fits on strollers, chairs, and on top of public changing tables. You can use it with legs or without. In at least one embodiment, it folds up with a carrying strap that you can hang from your stroller or keep it in the trunk of your car.

In at least one embodiment, an apparatus for changing a baby is provided comprising a plurality of sections, which are connected together and which are configured to be placed in an open state, in an assembled state, and in a closed state; wherein in the open state, each of the plurality of sections lies in substantially the same plane, and none of the plurality of sections overlaps any of the other of the plurality of sections; wherein in the assembled state, a first section of the plurality of sections is temporarily fixed at substantially a right angle with respect to a second section of the plurality of sections; wherein in the closed state, the first section overlaps the second section; and and wherein at least one of the first and second sections is padded.

The apparatus may further include a first strap having a first end and a second end; wherein the first end of the first strap is connected to the plurality of sections, and the second end of the first strap is connected to the plurality of sections so that the first strap is formed into a U-shape; and further comprising a means for holding plurality of sections in the closed state; and wherein the first strap can be used to pick up the plurality of sections.

The apparatus may further include a first or second strap; and a buckle; and wherein the first strap is attached to the buckle and the buckle and the first strap are configured to hold a child onto the at least one of the plurality of sections which is padded.

The apparatus may further include a first bag having an opening; wherein the first bag is attached to the plurality of sections and the bag is configured to receive diapers.

The apparatus may further include a first leg and a second leg; wherein the first leg and the second leg can be oriented substantially parallel to the plurality of sections in a flat state; and wherein the first leg and the second leg can be oriented at an angle with respect to at least one of the plurality of sections, wherein the angle is substantially greater than zero degrees, in an upright state.

The apparatus of claim may further include a second bag having an opening; wherein the second bag is attached to the plurality of sections opposite the first bag.

A method may also be provided comprising the steps of placing an apparatus as specified above in the open state; placing the apparatus in an assembled state; and placing the apparatus in a closed state.

DETAILED DESCRIPTION OF THE DRAWINGS

Figure 1A:
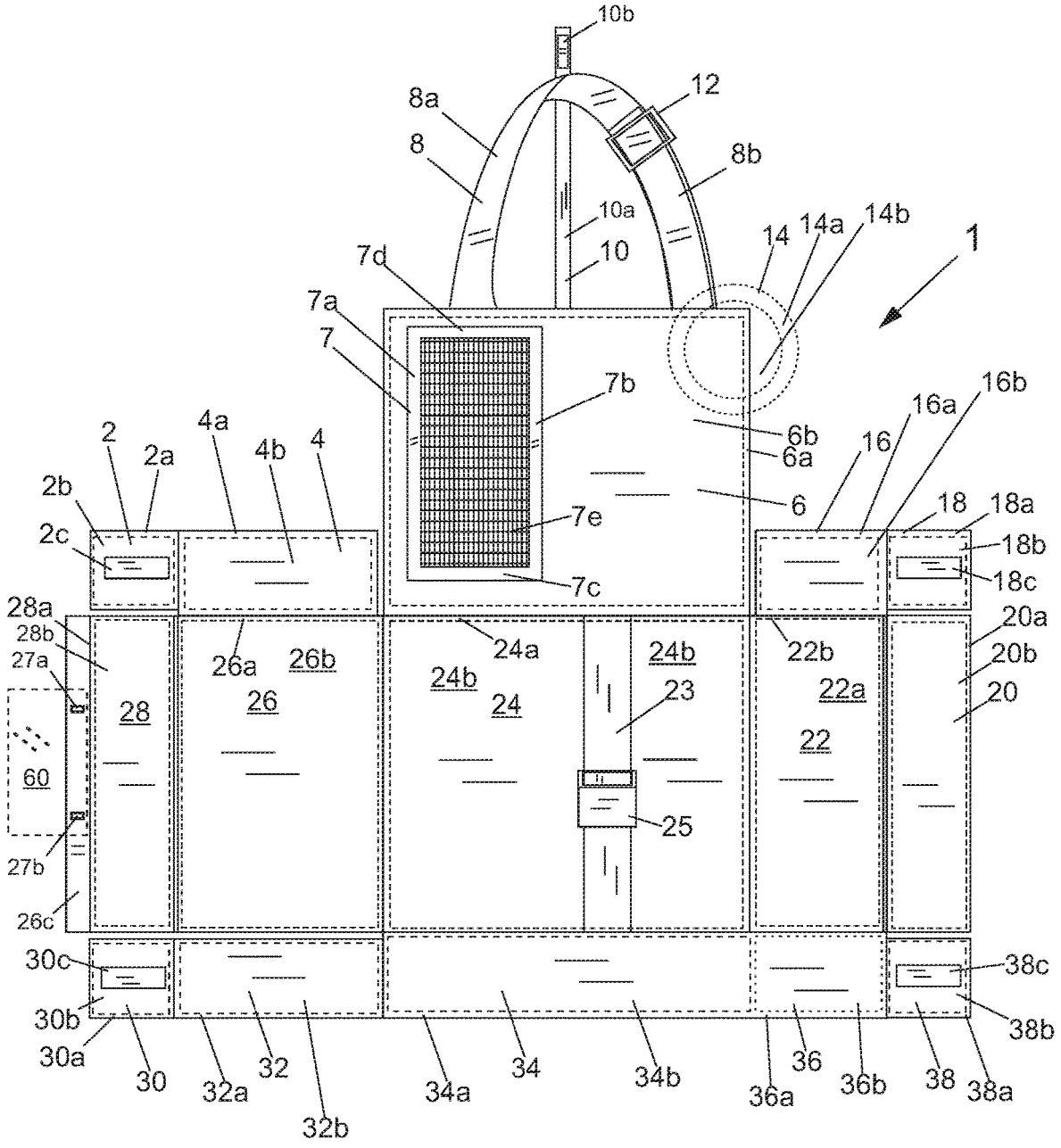
FIG. 1A shows top elevational view of an apparatus in accordance with an embodiment of the present invention, with the apparatus shown in an open state.
Figure 1B:
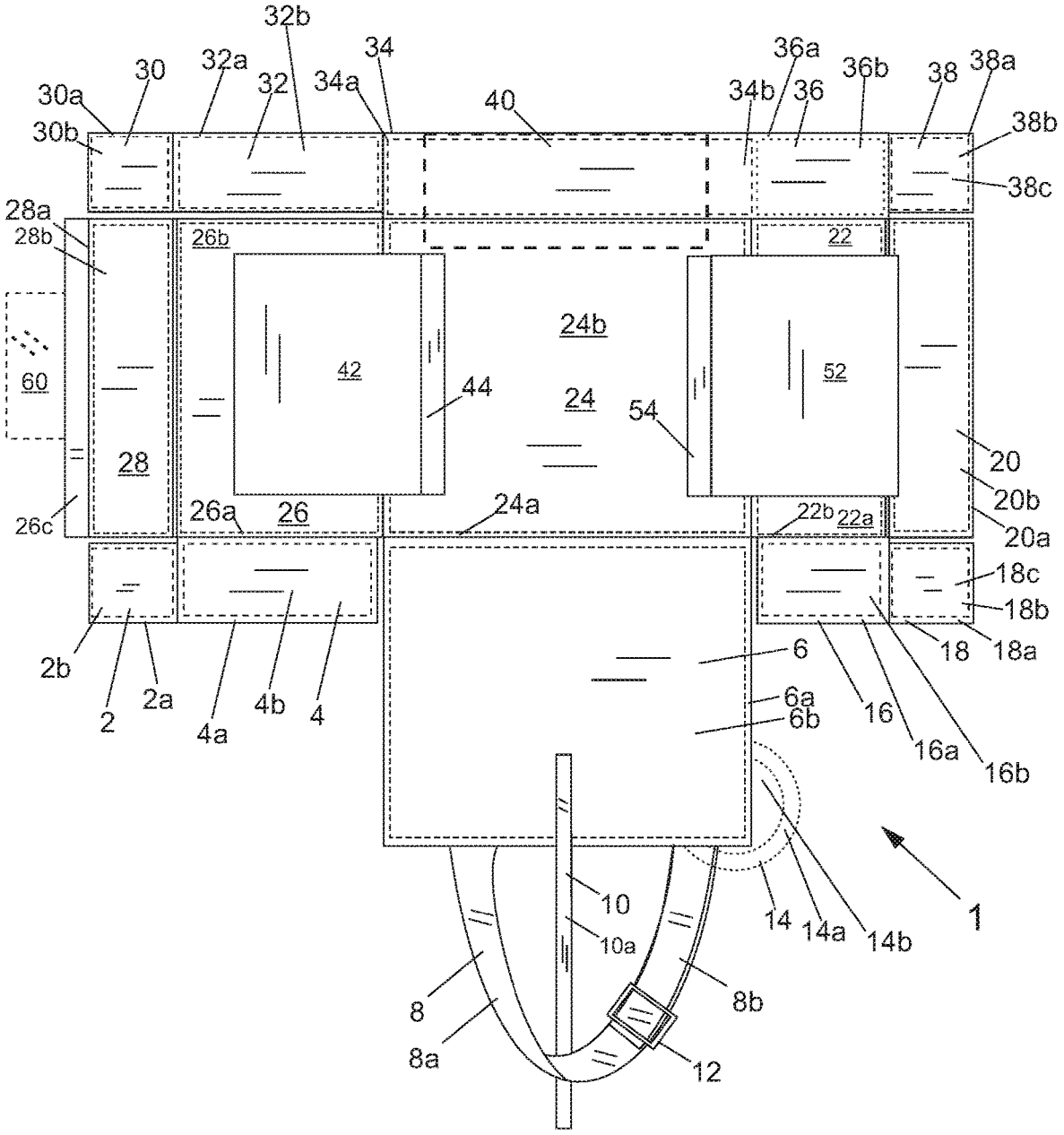
FIG. 1B shows bottom elevational view of an apparatus in accordance with an embodiment of the present invention, with the apparatus shown in an open state.

FIG. 1A shows top elevational view of an apparatus 1 in accordance with an embodiment of the present invention, with the apparatus 1 shown in an open state. FIG. 1B shows a bottom elevational view of the apparatus 1 in accordance with an embodiment of the present invention, with the apparatus 1 shown in the open state.

The apparatus 1 includes sections 2, 4, 6, 16, 18, 20, 22, 24, 26, 28, 30, 32, 34, 36, and 38. The apparatus 1 also includes straps 8, 10, and 23, buckle or device 12, optional mirror 14 (shown in dashed lines), and seat belt device or attachment device 25. The apparatus 1 further includes attached pocket 7. The apparatus 1 also includes legs or sections 42 and 52 connected to section 24 by sections 44 and 54. The legs 42 and 52 can be placed in a folded or flattened state as shown in FIG. 1B, to lie on top of and be substantially parallel to part of the combination of sections 26, 24, and 22 as shown in FIG. 1B. The legs 42 and 52 can also be placed in an open or supporting state shown in FIG. 2, to elevate the sections 22, 24, and 26, and other sections off of a ground or other surface. The legs 42 and 52 may be perpendicular to the sections 22, 24, and 26 in the state of FIG. 1B or at an angle, which may be between zero and ninety degrees, and may preferably be between forty-five and ninety degrees, in at least one embodiment.

The section 26 may have an extended or protruding portion 26*c* shown in FIG. 1A, on which is attached thereto clips or hooks 27*a* and 27*b* for attaching temporalily a small plastic bag or bags 60, which may be used to hold various items, which may be disposable, such as diapers and wipes.

Sections 2, 4, 16, 18, 20, 22, 24, 26, 28, 30, 32, 34, 36, and 38 may include stiff padded inner materials (such as padded cardboard or padded plastic, with cushion materials), whose locations are shown by dashed lines 2*a*, 4*a*, 16*a*, 18*a*, 20*a*, 22*a*, 24*a*, 26*a*, 28*a*, 30*a*, 32*a*, 34*a*, 36*a*, and 38*a*, inside of outer flexible materials (such as fabrics) 2*b*, 4*b*, 6*b*, 16*b*, 18*b*, 20*b*, 22*b*, 24*b*, 26*b*, 28*b*, 30*b*, 32*b*, 34*b*, 36*b*, and 38*b*, respectively. Section 6 may not be padded but may have a still inner material whose location is shown by dashed lines 6*a*.

Section 2 is connected to section 4 (but not section 28) so that section 2 can be folded on its junction line with section 4, and placed on top of section 4. Section 4 is connected to section 26 (but not to section 6), so that section 4 can be folded along its junction line with section 26, and placed on top of section 26.

Similarly or identically, section 18 is connected to section 16 (but not section 20) so that section 18 can be folded on its junction line with section 16, and placed on top of section 16. Section 16 is connected to section 22 (but not to section 6), so that section 16 can be folded along its junction line with section 22, and placed on top of section 22.

Section 30 is connected to section 32 (but not section 28) so that section 30 can be folded on its junction line with section 32, and placed on top of section 32. Section 32 is connected to section 34 (but not to section 26), so that section 32 can be folded along its junction line with section 34, and placed on top of section 34.

Section 38 is connected to section 36 (but not section 20) so that section 38 can be folded on its junction line with section 36, and placed on top of section 36. Section 36 is connected to section 22 so that section 36 can be folded along its junction line with section 22, and placed on top of section 22.

Section 28 is connected to section 26 so that section 28 can be folded on its junction line with section 26, and placed on top of section 26. Section 26 is connected to section 24 so that section 26 can be folded along its junction line with section 24, and placed on top of section 24.

Section 20 is connected to section 22 so that section 20 can be folded on its junction line with section 22, and placed on top of section 22. Section 22 is connected to section 24 so that section 22 can be folded along its junction line with section 24, and placed on top of section 24.

Figure 2:
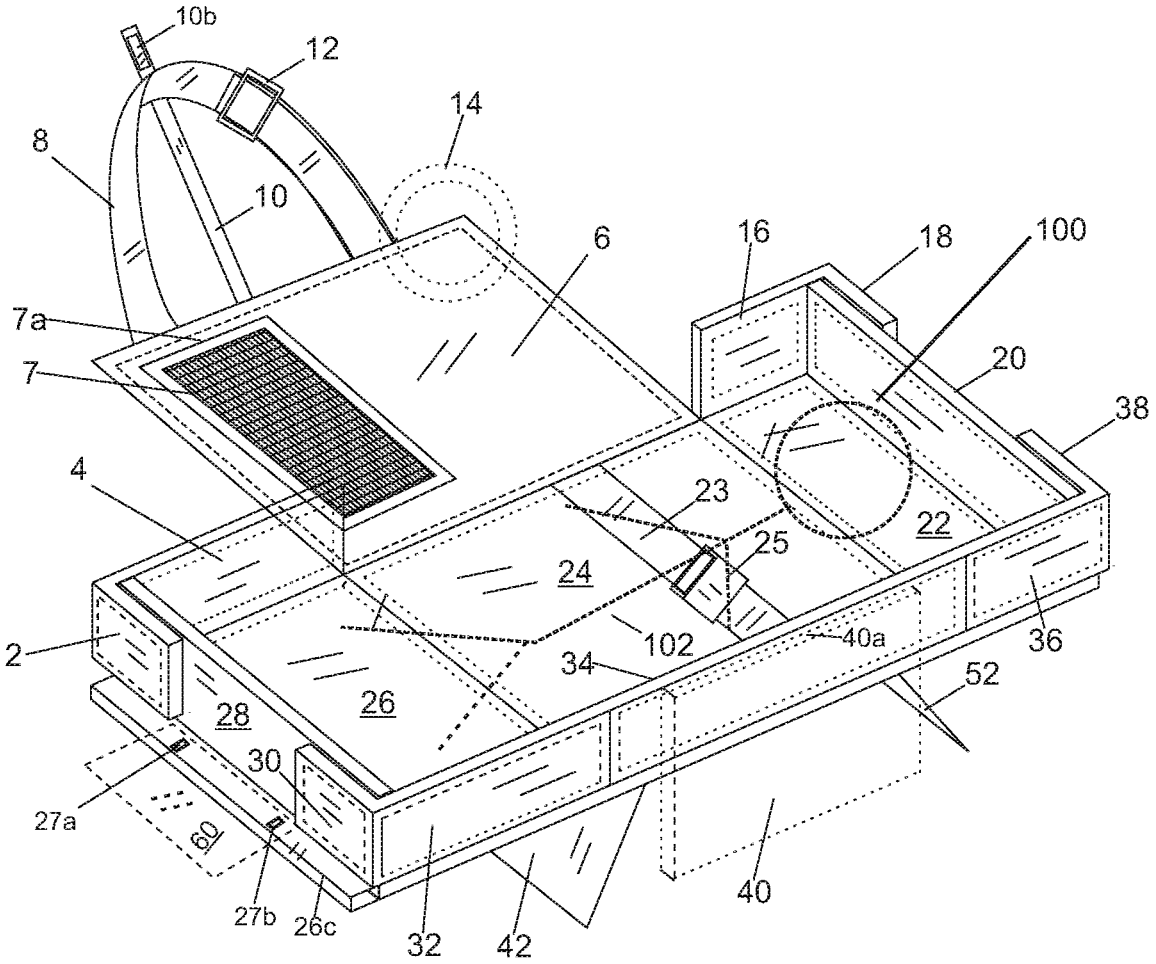
FIG. 2 shows a front, top, and right perspective view of the apparatus of FIG. 1A, with the apparatus of FIG. 1A shown in an assembled state.

FIG. 2 shows a front, top, and right perspective view of the apparatus 1 of FIG. 1A, with the apparatus 1 of FIG. 1A shown in an assembled state.

Although section 6 is shown flat, parallel and/or aligned with section 24 in FIG. 2, it can be placed perpendicular or at an angle with respect to section 24 and held perpendicular by the strap 8 being attached and/or placed over and/or around a car seat head rest or a baby stroller handle.

The sections 2, 30, 18, and 38 have connected thereto attachment devices 2*c*, 30*c*, 18*c*, and 38*c* which may include Velcro (trademarked) or hooks and/or loops. The section 28 may include two attachment devices (not shown) for mating with and/or connecting to the devices 2*c* and 30*c*, when the apparatus 1 is in the assembled state of FIG. 2. Similarly or identically, the section 20 may have two attachment devices (not shown) for mating with and/or connecting to the devices 18*c* and 38*c*, when the apparatus 1 is in the assembled state of FIG. 2.

The device 25 may be a known seat belt device, such as in a car. A child, such as the child 100, shown in dashed lines in simplified stick figure form, may be laid down on the sections 26, 24, and 22, as shown in FIG. 2, with the apparatus 1 in an assembled state, and the strap 23 may be placed over the child's torso or mid section 102 or generally over the child 100, so that the child 100 or torso 102 is between the strap 23 and the surface of section 24.

The device 25 may be a typical car seat belt which includes two pieces which come apart, to allow the child 100 to no longer be restrained by the device 25 and strap 23.

The apparatus 1 may also include a bag 40, shown in dashed lines, which may be attached to the section 34, and which may have a top opening 40*a*, but which may otherwise be closed and which may be used to hold clean diapers or other items. Similarly, the bag 7 may be open at top end 7*d* but closed at other ends 7*a*, 7*b*, and 7*c*, and items, such a clothing and other items may be inserted through top end 7*d*, into an inner chamber between net 7*e* and section 6.

Figure 3:
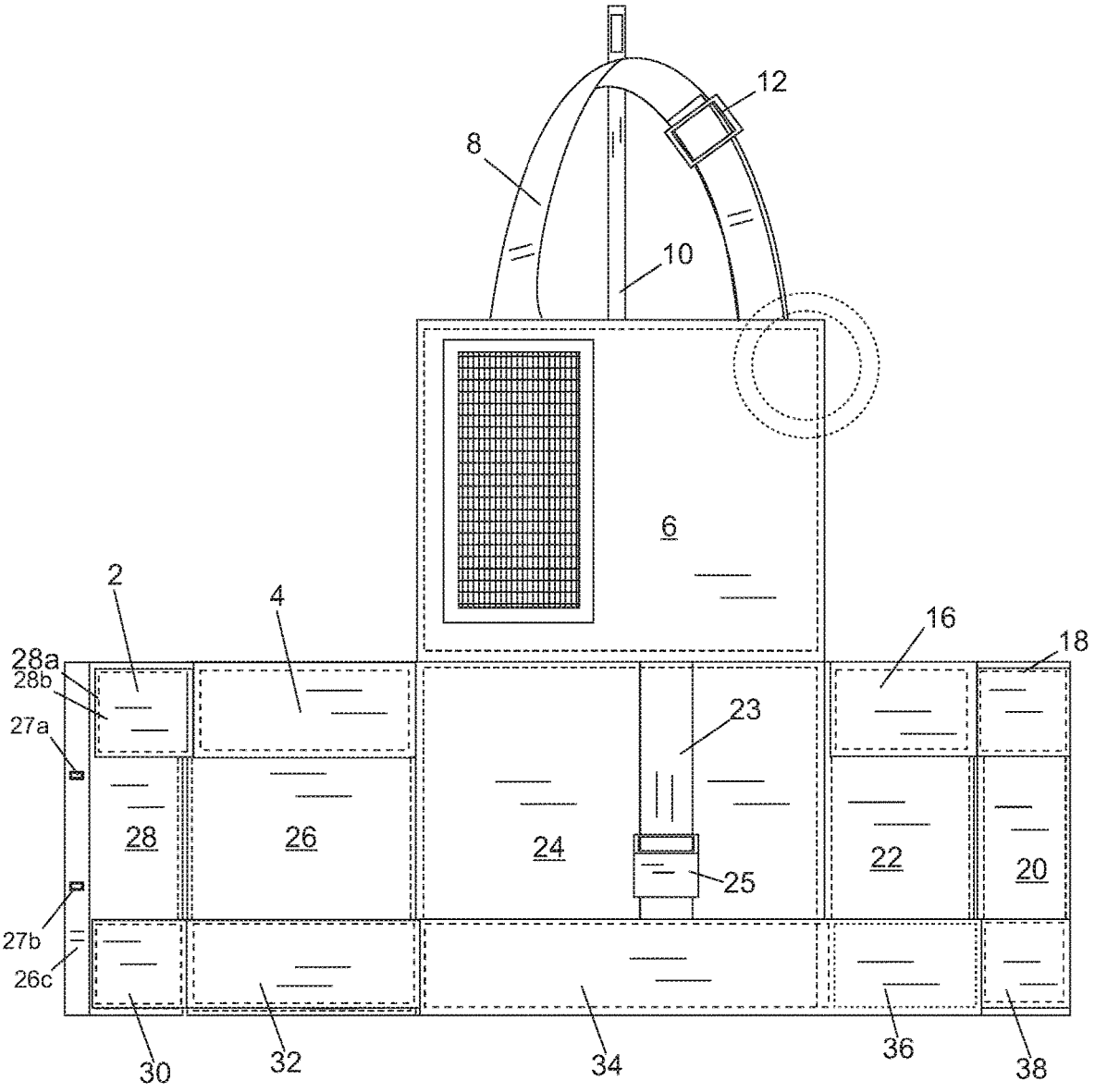
FIG. 3 shows a top view of the apparatus of FIG. 1A, with the apparatus of FIG. 1A shown in a first partially closed state.

FIG. 3 shows a top view of the apparatus 1 of FIG. 1A, with the apparatus 1 of FIG. 1A shown in a first partially closed state. The apparatus 1 has been changed from the open state of FIG. 1 to the first partially closed state by folding sections 30, 32, 34, 36, and 38 to be on top of part of sections 28, 26, 24, 22, and 20, respectively. In addition, the sections 2, 4, 16, and 18 have been folded to be on top of part of sections 28, 26, 24, 22, and 20, respectively.

Figure 4:
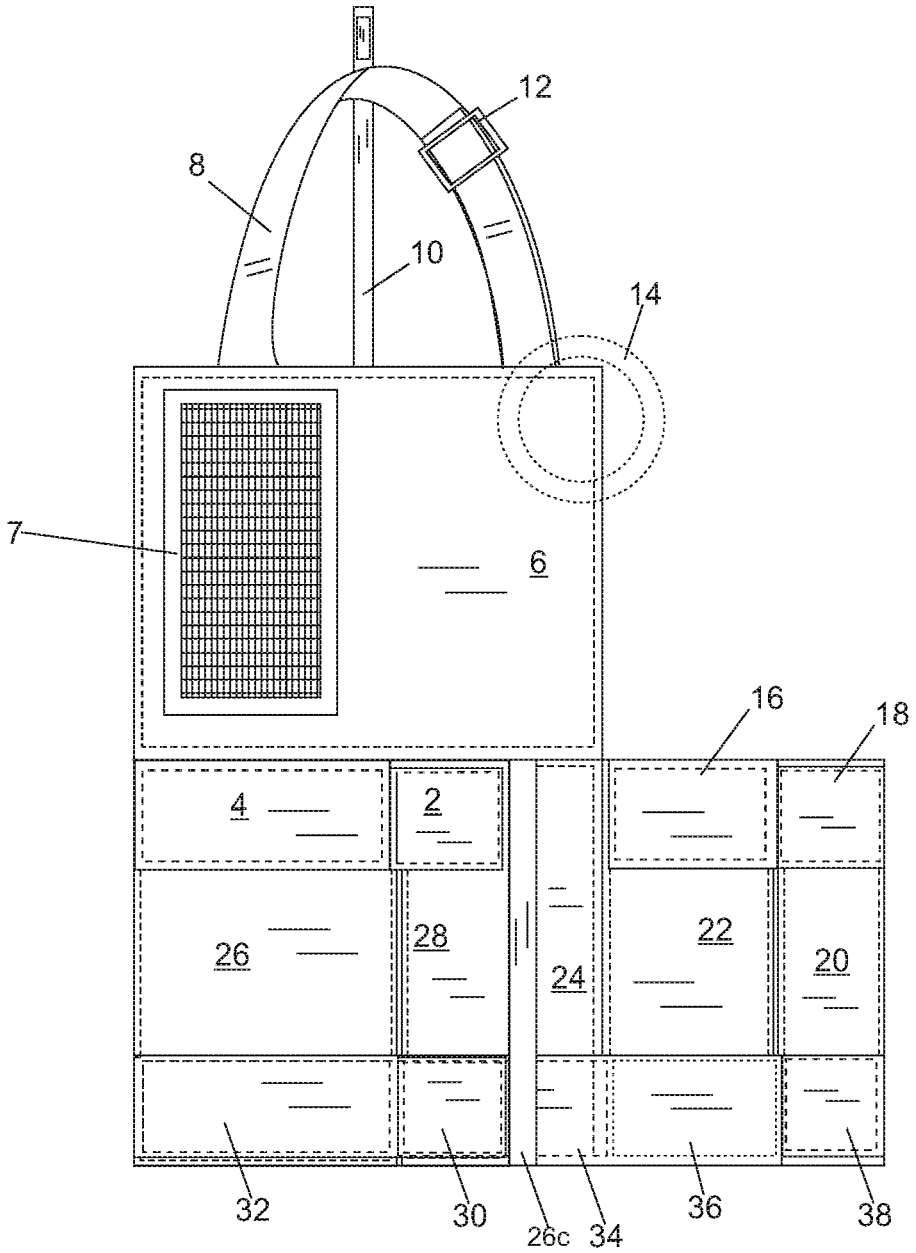
FIG. 4 shows a top view of the apparatus of FIG. 1A, with the apparatus of FIG. 1A shown in a second partially closed state.

FIG. 4 shows a top view of the apparatus 1 of FIG. 1A, with the apparatus 1 of FIG. 1A shown in a second partially closed state. The apparatus 1 has been changed from the first partially closed state of FIG. 3 to the second partially closed state by folding sections 2, 4, 30, and 32 onto part of section 24.

Figure 5:
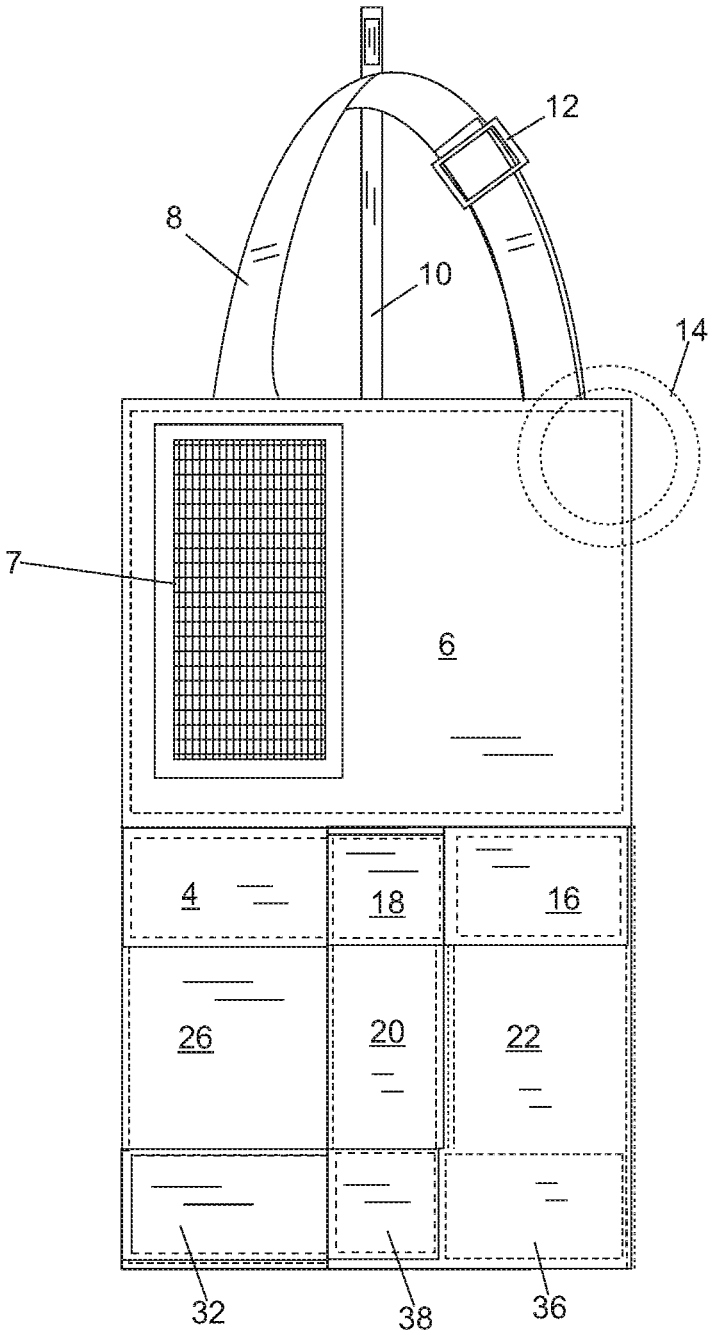
FIG. 5 shows a top view of the apparatus of FIG. 1A, with the apparatus of FIG. 1A shown in a third partially closed state.

FIG. 5 shows a top view of the apparatus 1 of FIG. 1A, with the apparatus 1 of FIG. 1A shown in a third partially closed state. The apparatus 1 has been changed from the second partially closed state of FIG. 4 to third partially closed state by folding sections 16, 18, 36, and 38 onto part of section 24.

Figure 6:
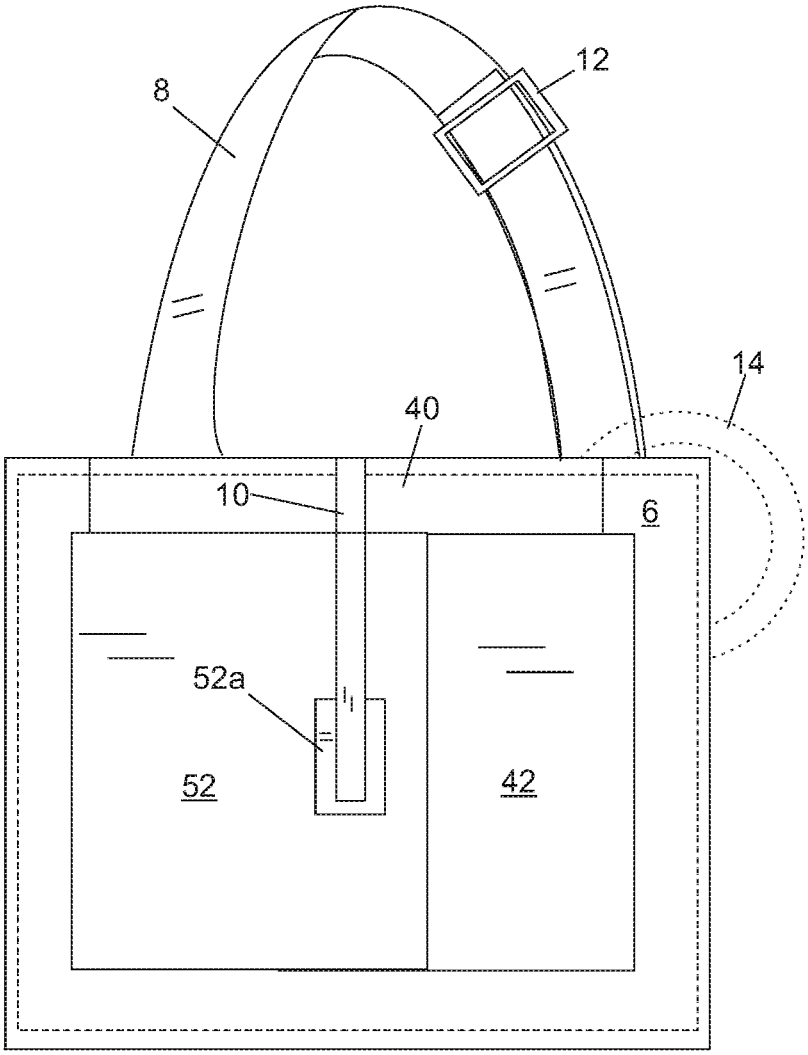
FIG. 6 shows a top view of the apparatus of FIG. 1A, with the apparatus of FIG. 1A shown in a fully closed state.

FIG. 6 shows a top view of the apparatus 1 of FIG. 1A, with the apparatus 1 of FIG. 1A shown in a fully closed state. The apparatus 1 has been changed from the third partially closed state of FIG. 5 to the fully closed state of FIG. 6 by folding section 6 on top of section 24, and then placing strap 10 on section 6 and attaching attachment device 10*b* to attachment device 6*a* on section 6. Attachment devices 10*b* and 6*a* may include Velcro (trademarked) and/or hooks and loops which mate together with each other.

To use the apparatus 1 in a vehicle, the adjustable strap 8 can be placed around the headrest of the vehicle seat, then detached from closed state of FIG. 6, (attachment device 10*b* detached from attachment device 6*a*) and then unfolded into the open state of FIG. 1. For first time use, you may need to adjust the height of the adjustable strap 8. If you are using the changing station or apparatus 1 in the front seat, you will need to make sure the legs or sections 42 and 52 which are attached to section 24 by sections 44 and 54 respectively, are unfolded and straight or at an angle such as in FIG. 2, to keep sections 26, 24, and 22, and other sections elevated from a ground surface or back seat. For back seat use, the legs 42 and 52 may be optional. You can have the height or lay the changing station flat. Next, the attachment devices 2*c* and 30*c* are connected to attachment devices not shown on section 28 and attachment devices 18*c* and 38*c* are connected to attachment devices not shown on section 20, to provide effectively, baby bumpers, for safety.

For extra security, there is a safety belt 25 and strap 23 for the baby. The mesh or net pocket 7 may be used for diapers and wipes and a mesh pocket 40 above the base of the changing area may be used to place the baby's clothes while changing the soiled diaper. On the top right there may be a mirror 14 or toy connector that allows you to attach car toys to distract the baby while you are changing the diaper. Another great feature, in at least one embodiment is the diaper disposal attachment or bag(s) 60 which can be attached to clips or attachment devices 27*a* and 27*b* located at the foot of the station, shown in FIG. 1A. This attachment is equipped with sealable, disposable, detachable plastic bags 60. You simply put the soiled diaper and wipes into the bag, seal the bag when you are finished, and detach bag(s) 60 to be discarded when you reach your destination. Simply fold in the sides, fold up changing station to attach to Velcro (trademarked) or attachment device 52*a* shown in FIG. 6 and remove strap 8 from headrest.

By using the apparatus 1, the baby's comfort level is increased by laying flat on a removable, washable padded mat. All of inner materials 2*a*, 4*a*, 6*a*, 16*a*, 18*a*, 20*a*, 22*a*, 24*a*, 26*a*, 28*a*, 30*a*, 32*a*, 34*a*, 36*a*, and 38*a*, shown by dashed lines may be padded for child's comfort. The parent/guardian is less stressed knowing that everything they need is right at their fingertips. Due to the diaper disposal system the parent/guardian, vehicle, stroller, etc. remain soil free and odor free. This multifunctional diaper changing station is the first of it's kind. You can virtually use this anywhere.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section;

wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, spaced apart from and opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, spaced apart from and opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state; and further comprising a first strap having a first end and a second end;

wherein the first end of the first strap is connected to the central section, and the second end of the first strap is connected to the central section so that the first strap is formed into a U-shape;

and further comprising a means for holding the plurality of sections in the closed state; and wherein the first strap can be used to pick up the plurality of sections.

2. The apparatus of claim 1 further comprising a first leg and a second leg;

wherein the first leg and the second leg can be oriented substantially parallel to the plurality of sections in a flat state; and wherein the first leg and the second leg are configured to be oriented at an angle with respect to at least one of the plurality of sections, wherein the angle is substantially greater than zero degrees, in an upright state; and wherein the first leg and the second leg are attached to the base, and are configured to be folded outward from underneath the base to be placed in an upright state.

3. The apparatus of claim 1 wherein the base is rectangular.

4. The apparatus of claim 1 wherein the left section does not overlap the right section or the central section in the assembled state;

the right section does not overlap the left section or the central section in the assembled state; and the central section does not overlap the left section or the right section in the assembled state.

5. The apparatus of claim 1 wherein the central section is configured to be changed in orientation from substantially parallel to the base to substantially perpendicular to the base without changing the orientation of the left section or the right section;

the left section is configured to be changed in orientation from substantially parallel to the base to substantially perpendicular to the base without changing the orientation of the central section or the right section; and the right section is configured to be changed in orientation from substantially parallel to the base to substantially perpendicular to the base without changing the orientation of the central section or the left section.

6. An apparatus comprising:

a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section;

wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, spaced apart from and opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, spaced apart from and opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state;

further comprising a first strap having a first end attached to the central section at the front peripheral edge of the base and a second end attached to the central section at the rear peripheral edge of the base; and a seat belt attachment device which includes two pieces which come apart; and wherein the seat belt attachment device is configured to be located between the front peripheral edge; and the rear peripheral edge of the base, when the two pieces of the seat belt buckle are together.

7. An apparatus comprising:

a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section;

wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, spaced apart from and opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, spaced apart from and opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state;

further comprising a first bag having an opening;

wherein the first bag is attached to the central section on a surface of the central section which faces the base when the central section is folded on top of at least part of the base, and the bag is configured to receive diapers.

8. A method comprising the steps of:

placing an apparatus in an open state;

placing the apparatus in an assembled state; and placing the apparatus in a closed state;

wherein the apparatus includes a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section; and and wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state; and wherein the central section is configured to be changed in orientation from substantially parallel to the base to substantially perpendicular to the base without changing the orientation of the left section or the right section;

the left section is configured to be changed in orientation from substantially parallel to the base to substantially perpendicular to the base without changing the orientation of the central section or the right section; and the right section is configured to be changed in orientation from substantially parallel to the base to substantially perpendicular to the base without changing the orientation of the central section or the left section.

9. The method of claim 8 wherein the apparatus further includes:

a first strap having a first end attached to the plurality of sections at the front peripheral edge of the base and a second end attached to the plurality of sections at the rear peripheral edge of the base; and a seat belt attachment device which includes two pieces which come apart; and wherein the seat belt attachment device is configured to be located between the front peripheral edge and the rear peripheral edge of the base, when the two pieces of the seat belt buckle are together.

10. The method of claim 8 wherein the apparatus further includes:

a first bag having an opening;

wherein the first bag is attached to the central section on a surface of the central section which faces the base when the central section is folded on top of at least part of the base, and the bag is configured to receive diapers.

11. The method of claim 8 wherein the apparatus further includes:

a first leg and a second leg;

wherein the first leg and the second leg are configured to be oriented substantially parallel to the plurality of sections in a flat state; and wherein the first leg and the second leg are configured to be oriented at an angle with respect to at least one of the plurality of sections, wherein the angle is substantially greater than zero degrees, in an upright state; and wherein the first leg and the second leg are attached to the base, and are configured to be folded outward from underneath the base to be placed in an upright state.

12. The method of claim 8 wherein the base is rectangular.

13. The method of claim 8 wherein the step of placing the strap around the headrest of the vehicle includes adjusting the height of the strap.

14. The method of claim 8 further comprising connecting a toy to a toy connector, which is connected to a surface of the central section which faces the base when the surface of the central section is on top of the base.

15. The method of claim 8 wherein the base in rectangular.

16. An apparatus comprising:

a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section;

wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, spaced apart from and opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, spaced apart from and opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state; and further comprising an adjustable strap attached to the central section; and wherein the adjustable strap is configured to be adjusted in height to permit the adjustable strap to be attached around a headrest of a vehicle while the base lays flat on a car seat of the vehicle.

17. An apparatus comprising:

a plurality of sections, which are connected together and which are configured to be placed in an open state, in an assembled state, and in a closed state;

wherein in the open state, each of the plurality of sections lies in substantially the same plane, and none of the plurality of sections overlaps any of the other of the plurality of sections;

wherein in the assembled state, a first section of the plurality of sections is temporarily fixed at substantially a right angle with respect to a second section of the plurality of sections;

wherein in the closed state, the first section overlaps the second section;

wherein at least one of the first and second sections is padded;

wherein one or more of the plurality of sections in the assembled state forms a base;

wherein the base has a width and a length;

wherein one of the plurality of sections is connected to the base along a left side peripheral edge of the base substantially spanning the width of the base;

wherein one of the plurality of sections is connected to the base along a right side peripheral edge of the base, spaced apart from and opposite the left side peripheral edge of the base, substantially spanning the width of the base;

wherein one or more of the plurality of sections is connected to the base along a front peripheral edge of the base, substantially spanning the length of the base;

wherein the one of the plurality of sections connected along the left side peripheral edge, the one of the plurality of sections connected along the right side peripheral edge, and the one or more of the plurality of sections connected along the front peripheral edge of the base are configured to be simultaneously held in a substantially perpendicular orientation with respect to the base by connecting one or more attachment devices of the plurality of sections to one or more of the plurality of sections in the assembled state;

wherein the one or more attachment devices of the plurality of sections are configured to be disconnected from one or more of the plurality of sections to permit the one of the plurality of sections connected along the left side peripheral edge, the one of the plurality of sections connected along the right side peripheral edge, and the one or more of the plurality of sections connected along the front peripheral edge of the base to be changed from substantially perpendicular to the base in the assembled state to substantially parallel to the base in the open state;

wherein a left section, a central section, and a right section of the plurality of sections is connected to the base along a back peripheral edge of the base, spaced apart from and opposite the front peripheral edge of the base;

wherein the central section is between the left section and the right section;

wherein the left section is configured to be folded along the back peripheral edge of the base from substantially parallel to substantially perpendicular with respect to the base without changing the right section or the central section in orientation with respect to the base;

wherein the right section is configured to be folded along the back peripheral edge of the base from substantially parallel to substantially perpendicular with respect to the base without changing the left section or the central section in orientation with respect to the base;

wherein the central section is configured to be folded along the back peripheral edge of the base from substantially parallel to substantially perpendicular with respect to the base without changing the left section or the central section in orientation with respect to the base; and wherein the left section, the central section, and the right section together substantially span the length of the base in the assembled state; and further comprising a toy connector configured to allow a toy to be attached to a surface of the central section which faces the base when the surface of the central section is on top of the base.

* * * * *